US005684757A

United States Patent [19]

Eitrich

[11] Patent Number: 5,684,757

[45] Date of Patent: Nov. 4, 1997

[54] ELECTRONIC CIRCUIT DEVICE FOR ANAYSIS OF A DIGITAL SIGNAL FROM A ROTATIONAL POSITION TRANSMITTED

[75] Inventor: Frank-Thomas Eitrich, Reutlingen, Germany

[73] Assignee: Robert Bosch GmbH, Stuttgart, Germany

[21] Appl. No.: 454,110

[22] PCT Filed: Oct. 12, 1994

[86] PCT No.: PCT/DE94/01198

§ 371 Date: May 26, 1995

§ 102(e) Date: May 26, 1995

[87] PCT Pub. No.: WO95/12063

PCT Pub. Date: May 4, 1995

[30] Foreign Application Priority Data

Oct. 26, 1993 [DE] Germany ..... 43 36 390.3

[51] Int. Cl.[6] ..... G04B 47/00; F02P 5/00

[52] U.S. Cl. ..... 368/10; 368/113; 123/416; 123/478

[58] Field of Search ..... 368/8, 91, 10, 368/107–113; 123/416–418, 422, 478, 491, 492; 364/569

[56] References Cited

U.S. PATENT DOCUMENTS 4,245,605 1/1981 Rice et al. ..... 123/492
4,267,810 5/1981 Wesemeyer et al. ..... 123/416

FOREIGN PATENT DOCUMENTS 0082535 6/1983 European Pat. Off. .
2640791 4/1981 Germany .
93-20346 10/1993 WIPO .

*Primary Examiner*—Vit W. Miska
*Attorney, Agent, or Firm*—Michael J. Striker

[57] ABSTRACT

The electronic circuit device for analysis of a periodically repeating digital signal from a rotational position transmitter, which includes groups of events, each of which has a first and last event and at least one additional event between them, includes a first counter (10) for counting periodically generated pulses (t1) fed to it; a counting device (14) for counting the events in each group; a detecting device for the first and last event of each group; and a circuit device for feeding the periodically generated pulses (t1) to the first counter between the first and last event detected by the detecting device to form a counter count. This circuit device includes an and-gate (16) whose output is connected with the first counter (14) and whose inputs are connected to receive the periodically generated pulses (t1) and a first input signal (C1) between the first event and the last event of each group so that the and-gate (16) generates an output signal at its output between the first event and the last event of each group. A memory for storing the counter count of the first counter is also provided.

6 Claims, 2 Drawing Sheets

ELECTRONIC CIRCUIT DEVICE FOR ANAYSIS OF A DIGITAL SIGNAL FROM A ROTATIONAL POSITION TRANSMITTED

BACKGROUND OF THE INVENTION

The invention relates to an electronic counter circuit for time-domain measurement of a digital signal of any periodic signal waveform, the digital signal comprising a series of periodic events in groups, and more particularly, to an electronic circuit for analyzing a digital signal from a rotational position detector.

It is known for electronic counter circuits to be used in many areas of technology. These circuits are used for quantitative detection of a continually repeating process. The counting function is in this case initiated by applying a counting signal at an event-dependent clock frequency to the input of a counter which belongs to the counter circuit, and counts at an event-independent counting frequency. If event assessment is intended to be carried out, a gate logic device is connected upstream, by means of which individual clock pulses can be deliberately masked out. This results in the counter counting correspondingly slower, and event-dependent appraisal of the count thus being possible.

In the case of measurement of a time duration of a signal, it is known for a clock signal at a fixed frequency to be applied to the input of a counter which belongs to a counter circuit. A gate logic device is used to pass this clock signal through to the counter only during the signal time of interest and to mask it out otherwise. The counter thus does not count while the clock signal is masked out. If the count is reset to a predetermined reset value during the signal time which is not of interest, the count approximately corresponds to the time duration of the signal. If resetting to the reset value is not carried out, the count difference corresponds to the time duration of the signal. If it is intended to use this known counter circuit, for example, in the time-domain measurement of a digital signal having any periodic signal waveform, it is, however, disadvantageous that, if the count of the counter is intended to be used for a further assessment of events which define the duration of the digital signal, particularly short reaction times are possible only by means of very complex circuits and/or program structures because of the large number of events to be recorded.

SUMMARY OF THE INVENTION

It is an object of the present invention to provide an electronic counter of the above-described type which avoids the above-described disadvantages.

According to the invention, the electronic circuit device for analysis of a periodically repeating digital signal comprising a plurality of events, especially from a rotational position transmitter, comprises a first counter including means for counting a plurality of periodically generated pulses fed to the first counter; means for counting the events in each group; means for detecting the first event and the last event of each group; means for feeding the periodically generated pulses to the first counter between the first event and the last event detected by the means for detecting to form a counter count; and means for storing the counter count of the first counter determined by the first counter at the last event of each group.

In contrast, the electronic counter circuit according to the invention has the advantage that time-domain measurement of a digital signal having any periodic signal waveform is possible using simple circuit modules which can easily be implemented. Since a first counter counts periodically generated pulses which are passed through by a gate logic device only for the time which is defined by a first event and a last event of an event group and additional events, which are located between these events, are masked out, it is possible in a highly advantageous manner to process automatically virtually any periodic digital signal, without any further actions after the initialization, once the counter circuit has initially been synchronized, and at the same time to indicate a current count, even in the case of possibly defective signals, which count corresponds to the actual duration of the currently applied digital signal. The count of the counter can in this case advantageously be stored, so that this count can be picked off for further control functions in the case of definition of a next time duration of a digital signal. In consequence, the electronic counter circuit can be simplified overall, since the display and further processing of the count are largely rid of real-time-critical tasks which require a particularly short reaction time.

A number of advantageous embodiments of the invention are possible. In one embodiment the means for feeding the periodically generated pulses to the first counter between the first event and the last event comprises an and-gate having an output, a first input and a second input and an input of the first counter is connected to the output of the and-gate. The second input of the and-gate advantageously is connected to receive the periodically generated pulses and the first input of the and-gate is connected to receive a first signal between the first event and the last event of each group such that the and-gate generates an output signal at the output between the first event and the last event of each group.

A partial circuit portion is another preferred feature of the invention and it includes a second counter including means for counting the events of each group to form an event count, a memory for storing the event count of each group; and means for generating the first signal applied to the first input of the and-gate according to the event count stored in the memory and at least one count value in the second counter.

In other embodiments of the invention an additional partial circuit portion is provided including tabular correlation means for correlating each count value of the second counter with an output value supplied to the first input of the and-gate. The tabular correlation means for correlating each count value of the second counter with an output value supplied to the first input of the and-gate comprises a relative memory device and a comparator. The additional partial circuit portion advantageously comprises a third counter whose counting state contains information regarding each group which is fed to another tabular correlation means for correlating a number of excluded events of each group and means for transferring the number of excluded events for each group to the second counter, the second counter including means for leaving the number of excluded events out of the event count of the second counter.

BRIEF DESCRIPTION OF THE DRAWING

The invention is explained in more detail in the following text, using exemplary embodiments and with reference to the associated drawings, in which.

DESCRIPTION OF THE EXEMPLARY EMBODIMENTS

Figure 1:
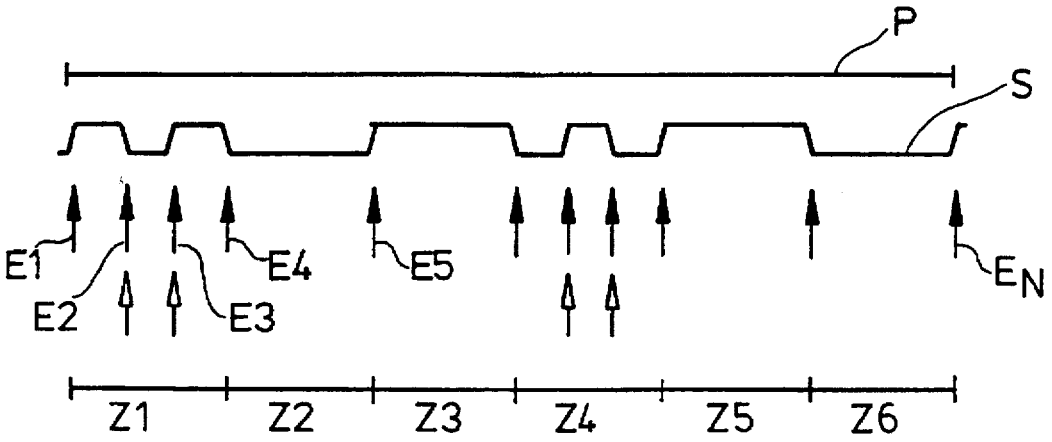
FIG. 1 shows an overview of a possible digital signal.

FIG. 1 shows the possible waveform of a digital signal, using the example of a segment encoder on a camshaft of a six-cylinder internal combustion engine. A segment signal encoder, which has segments distributed over the circumference, is in this case arranged on a camshaft of the internal combustion engine. An event period P is illustrated, within which a specific number of events E are detected. The events E are in this case produced by positive and negative edges of the segments which are arranged on the encoder wheel, by means of a suitable sensor identification. A segment or a segment gap is assigned on the encoder wheel to each of the six cylinders Z1 to Z6. Thus, the first cylinder Z1 is characterized by the assignment of the events E1 to E4. This means that a control function which is not illustrated further here, for example an ignition control function which relates to the cylinder Z1, can be initiated by signalling the occurrence of the event El. The cylinder Z2 is characterized in the same manner by the events E4 and E5, and the further cylinders by the corresponding events produced by the segments. The events which can in each case be assigned to one cylinder in this case form an event group. Since both the 360° and 720° angles of the camshaft must be taken account of for engine control, at least one intermediate event must be detected in at least two segments or segment gaps assigned to the cylinders, in this case E2 and E3, in order that it is possible to distinguish between the 360° and 720° angles. Since, as already mentioned, the events E2 and E3 are necessary only for specific control purposes, it is necessary to mask them out for example in the case of segment time measurement between the events E1 and E4. If the events E2 and E3 were not masked out, the digital signal waveform which is designated here by S would be evaluated. It is thus impossible to assign a segment time duration to the associated cylinder. Reference is now made to the sequence of events E, which are illustrated by way of example and are shown in FIG. 1, for the further explanation of the electronic counter circuit.

Figure 2:
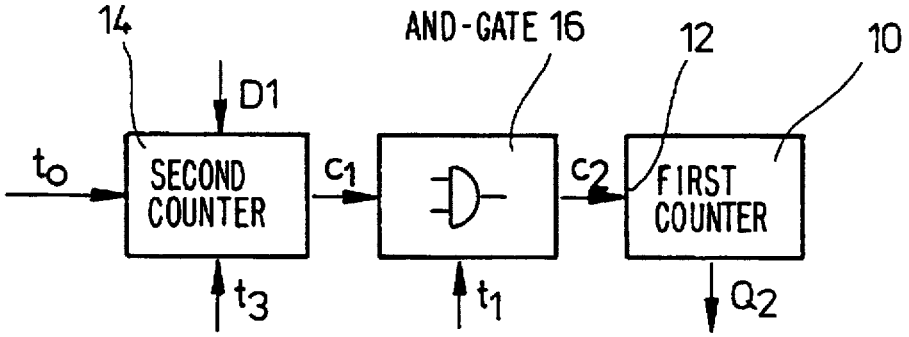
FIG. 2 shows a block diagram of time-domain measurement of a digital signal.

FIG. 2 shows an electronic counter circuit which includes a first counter 10 which is incremented or counts in response to a periodically generated counting pulses C2 fed to the input 12. The counting pulses C2 are produced by a second counter 14, which is incremented or counts on input of the counting pulse to according to the number of the events, E, via and-gate logic device 16 and by externally produced periodically generated counting pulse t1. This results in the counter 10 experiencing a specific count change of its count Q2 as a result of the influence of the control signal C1, so that it is possible to deduce the time in which the control signal C1 is present via the known external counting clock t1 and the difference between the count Q2 at the start of the control signal C1 and at the end of the control signal C1.

The counter 14 in this case counts the events E, starting with an external synchronization signal t3. The external synchronization signal t3 can in this case be detected by suitable measures on the segment encoder wheel of the camshaft at the same time as the event E1. The synchronization signal t3 sets the counter 14 to a reset value, which is preferably zero. Starting from this reset value, the counter 14 starts to count the number of events during the event period P. The number of expected events E during the event period P is in this case known to the counter 14 as the value D1. The count of the counter 14 is read into the gate logic device 16, which provides the pulsed signal C2 as a function of the count. The events E2 and E3 must be masked out in the example shown in FIG. 1 because the counting signal C2 is intended to be present only for the time in which the digital signal S is intended to be present for a cylinder Z and hence for a segment.

Figure 3:
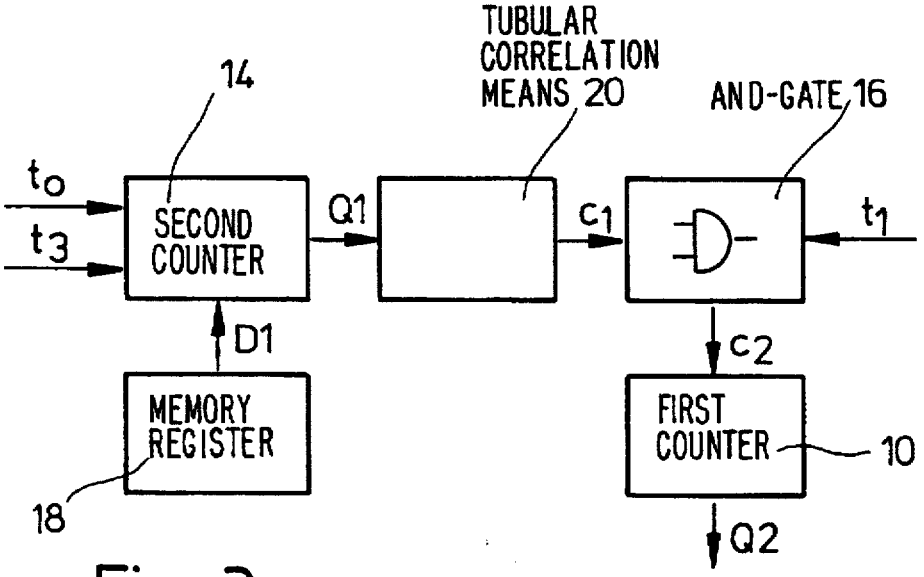
FIG. 3 shows a block diagram of a first design variant of FIG. 2.

FIG. 3 shows a variant of the masking out of the events E2 and E3. Parts which are the same as those in FIG. 2 are provided with the same reference symbols and are not explained again here. The number of expected events E is in this case made available from a register 18 to the second counter 14, in the form of the value D1. The counter 14 uses the synchronization signal t3 to start counting the number of events E, which number is predetermined by the clock frequency t0. The count Q1, which changes whenever a next event E occurs, of the counter 14 is transferred into a tabular correlation means 20. The table 20 includes, for example, a read only memory or a programmable memory. The expected events E1 to En are stored in the table, the table 20 being constructed such that it knows that the start of that segment which is to be assigned to the cylinder 1 is to be assigned to the event El, and the end of that segment which is to be assigned to the cylinder 1 and the start of that segment which is to be assigned to the cylinder 2 are to be assigned to the event E4. Each of the expected events E within the event period P is coded in the tabular correlation means 20 in this form. Since the count Q1 of the counter 14 now changes as a function of the occurrence of the respectively next event E, the tabular correlation means 20 can assign each count Q1 to the corresponding segment of a cylinder Z. This results in the tabular correlation means 20 making a control signal C1 available which corresponds exactly to the duration in which in each case one segment, which is to be assigned to a cylinder Z, is detected by the sensor which provides the events E. The gate logic device 16 then uses the external periodic signal or pulse train t1 and the control signal C1 to form the periodically generated pulses C2, so that the counter 10 passes through a value range corresponding to the information given to the control signal C1. The value range which is passed through is then available as the count Q2 and can be used, for example, for cylinder-dependent control, especially ignition time control, or for driving valves. Cyclic repeatability of the time measurement of the individual segments within the event period P is ensured via the synchronization signal t3 and the register 18. As a result of the known value D1 of the expected events from the register 18 it is possible to apply the synchronization signal t3 to the electronic counter circuit only once, since, on reaching the expected number of events, the counter 14 is automatically reset to its reset value, preferably the value zero.

Figure 4:
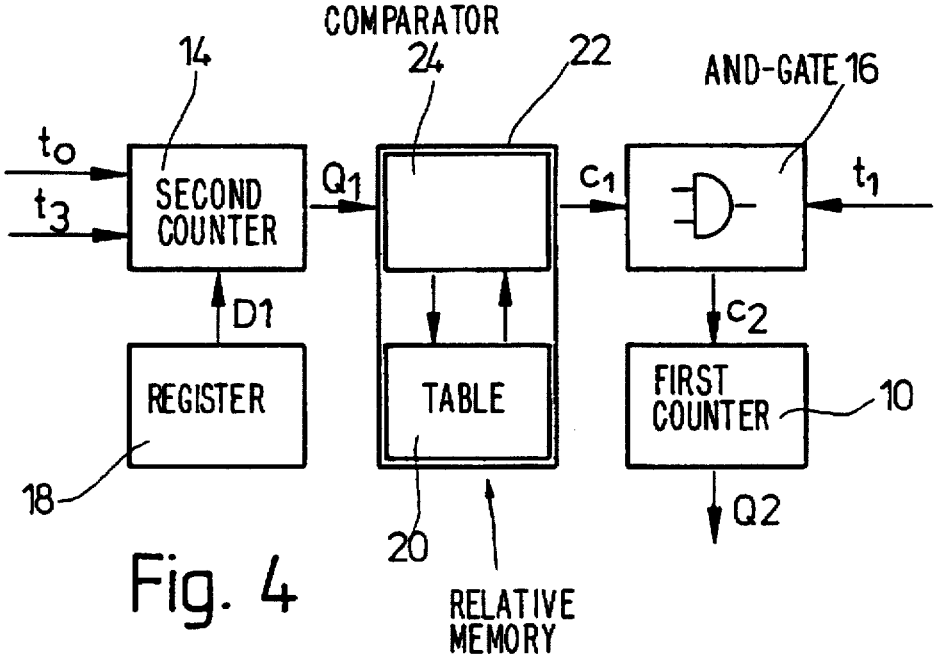
FIG. 4 shows a block diagram of a second design variant of FIG. 2.

FIG. 4 shows a another embodiment for masking out the events E2 and E3 which are not required for segment time determination. Parts which are the same as those in FIG. 1 are once again provided with the same reference numbers, and are not explained again. The table 20 is here replaced by a relative memory 22 which takes over the function of the table 20 and of a comparator 24 at the same time, that is to say assigns the changing count Q1 of the counter 14 to the respective segments of the cylinders Z. In consequence, it is possible to dispense with the synchronization signal t3.

According to a further embodiment, which is not shown in FIGS. 3 and 4, it is possible to link the clock t0, which is dependent on the occurrence of the events E, to the periodically generated pulses C2 such that the tabular correlation means 20 or the relative memory 22 continually predetermines the response of the counter 10 to the next expected event E. In consequence it is possible to design the time response of the table 20 and of the gate logic device 16 or of the relative memory 22 and the gate logic 16 to be highly non-critical, so that relatively slow logic devices and circuit elements can also be used.

Figure 5:
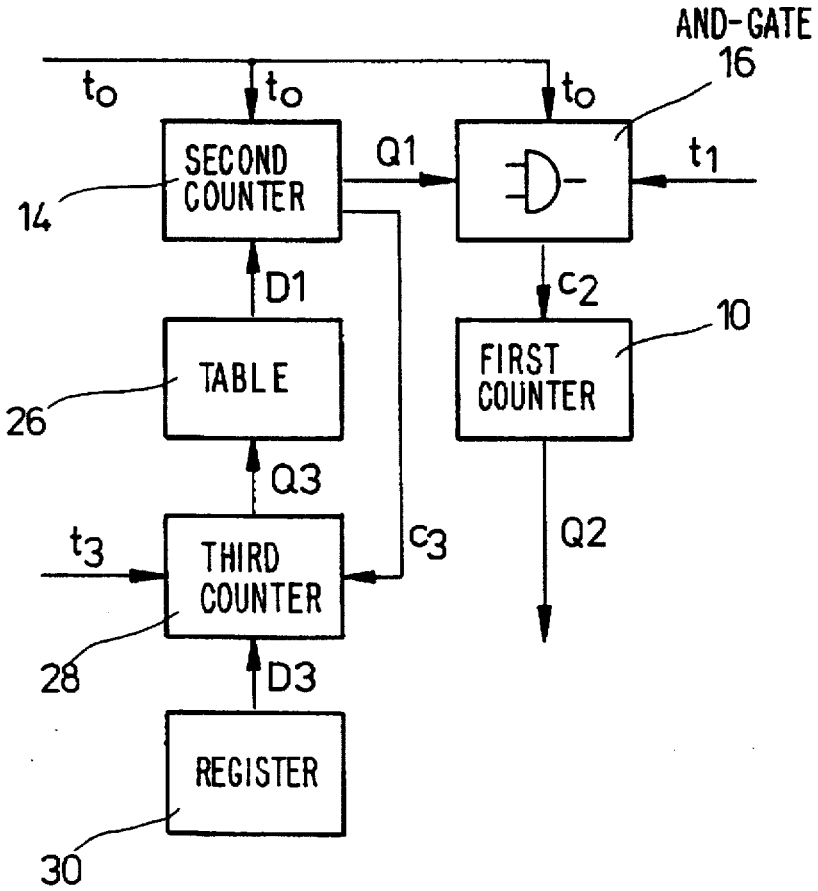
FIG. 5 shows a block diagram of a third design variant of FIG. 2.

FIG. 5 shows another embodiment of the masking out of the events E2 and E3 which are not required for segment time determination. The value D1 of the number of expected events E is in this case provided from a table 26 into which the count Q3 of a third counter 28 is read. The table 26 in this case reports to the second counter 14 the number of events E to be omitted in the counting clock t0 which is dependent on the occurrence of the events E. The counter 14 thus also internally counts the events to be omitted without its count Q1 having to be changed and does not change this count Q1 until the corresponding number of events have been omitted. The third counter 28 is in this case fed back by means of a control signal C3, so that the counter 28 can change its count Q3 in accordance with the number of actually occurring events E. The number of expected events within an event period P or an event group is read out of a register 30 to the counter 28 as the value D3. The counter 28 counts the event group and uses the count Q3 to report to the table 26 how many events are to be omitted in the currently present event group. This variant results in the counter 10 being jointly controlled by the counters 14 and 28, in that the pulsed signal C2 depends on their instantaneous count Q1 or Q3 respectively.

In the embodiments shown in FIGS. 3 to 5, the circuit complexity for the table 20 or 26 respectively is proportional to the number of events E per event period P or to the number of time measurements, that is, the segments per event period P. This circuit complexity can be reduced if, in the case of continuous time measurement between the individual segments, that is the event E4 in the example shown, the end of the segment which is to be assigned to the cylinder 1 and the start of the segment which is to be assigned to the cylinder Z2 are indicated simultaneously, and the end of the first measurement process immediately initiates the start of the next measurement process. That count Q2 of the counter 10 which is indicated at the end of each segment can, if required, be buffer-stored for further evaluations and the counts Q2 at the end of each segment can be accumulated.

Overall, it becomes clear that the circuits which are shown in FIGS. 2 to 5 of each periodic digital sensor signal S can be processed automatically without any further actions, once a first initialization has been carried out by the synchronization signal t3. A large proportion of the possible signal defects can be filtered out of the event pulses t0 and the synchronization signal t3 by means of the plausibility tests by the tabular correlation means 20 and the relative memory 22. Defective signals which reach the counter circuit despite the plausibility test cause only a small amount of damage since individual defects are corrected by the register 18 or 30 respectively, at the latest after the next synchronization. Furthermore, rapid identification of any failure of the event pulses t0 is possible by means of the counter 10 overflowing as a result of this.

The invention can be used, by way of example, in the following two applications.

In the first application, the external counting clock t1 counts at a fixed, predetermined frequency, the count Q2 at the end of each segment Z1, Z2, . . . , Z6 (cf. FIG. 1) corresponding to the time duration of this segment.

In the second application, the gate logic device 16 is modified such that the counter clock C2 is varied in such a manner that the counter 10 reaches a respectively predetermined value at the end of each segment Z1, Z2, . . . , Z6 (cf. FIG. 1). This counting clock is regulated using the known PLL (phase locked loop) principle.

While the invention has been illustrated and described as embodied in an electronic circuit device for analysis of a periodically repeating digital signal comprising a plurality of events, especially from a rotational position transmitter, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. An electronic circuit device for analysis of a digital signal from a rotational position transmitter, wherein said digital signal periodically repeats and comprises a plurality of groups of events, each of said group containing a first event and a last event and at least one group having at least one additional event between said first event and said last event, said electronic circuit device comprising a first counter including means for counting a plurality of periodically generated pulses (t1) fed to the first counter;

means for determining the number of said events of each of said groups;

means for detecting the first event and the last event of each of said groups;

means for feeding said periodically generated pulses (t1) to said first counter between said first event and said last event detected by said means for detecting to form a counter count; and means for storing said counter count of said first counter determined by said first counter at said last event of each of said groups.

2. The electronic circuit device as defined in claim 1, wherein said means for feeding said periodically generated pulses (t1) to said first counter between said first event and said last event comprises an and-gate having an output, a first input and a second input; said first counter has an input; said input of said first counter is connected to said output of said and-gate; said second input of said and-gate is connected to receive said periodically generated pulses (t1) and said first input of said and-gate is connected to receive a first signal (C1) between the first event and the last event of each of said groups such that said and-gate generates an output signal at said output between the first event and the last event of each of said groups.

3. The electronic circuit device as defined in claim 2, further comprising a partial circuit portion, said partial circuit portion comprising a second counter including said means for determining the number of said events in each of said groups to form an event count and a memory for storing the event count for each of said groups; and said partial circuit portion includes means for generating said first signal (C1) applied to said first input of said and-gate according to said event count stored in said memory and at least one count value in said second counter.

4. The electronic circuit device as defined in claim 3, further comprising an additional partial circuit portion including tabular correlation means for correlating each of said count values of said second counter with an output value supplied to said first input of said and-gate.

5. The electronic circuit device as defined in claim 4, wherein said tabular correlation means for correlating each of said count values of said second counter with an output value supplied to said first input of said and-gate comprises a relative memory device and a comparator.

6. The electronic circuit device as defined in claim 4, wherein said additional partial circuit portion comprises a third counter whose counting state contains information regarding each of said groups and fed to another tabular correlation means for correlating a number of excluded events of each of said groups and means for transferring said number of excluded events for each of said groups to said second counter, said second counter including means for leaving said number of excluded events out of said event count of said second counter.

* * * * *